United States Patent [19]

Demuth

[11] Patent Number: 4,839,266

[45] Date of Patent: Jun. 13, 1989

[54] RECORDING SYSTEM FOR IRRADIATION THERAPY

[75] Inventor: Gunther Demuth, Langen, Fed. Rep. of Germany

[73] Assignee: E. I. Du Pont de Nemours and Company, Wilmington, Del.

[21] Appl. No.: 17,890

[22] Filed: Feb. 24, 1987

[30] Foreign Application Priority Data

Apr. 29, 1986 [DE] Fed. Rep. of Germany ..... 3614476

[51] Int. Cl.[4] ..... G03C 1/02; G03C 5/16; G03C 1/94

[52] U.S. Cl. ..... 430/524; 430/363; 430/567; 430/568; 430/966; 378/185; 250/475.2

[58] Field of Search ..... 430/139, 567, 568, 524, 430/966, 967, 363; 378/185, 186; 250/327.2, 475.2, 484.1

[56] References Cited

U.S. PATENT DOCUMENTS

| | | | |
|---|---|---|---|
| 2,509,766 | 5/1950 | Gross | 430/363 |
| 3,872,309 | 3/1975 | De Belder et al. | 450/483.1 |
| 3,924,127 | 12/1975 | Cheret et al. | 378/185 |
| 4,399,363 | 8/1983 | Bauer | 250/483.1 |
| 4,425,426 | 1/1984 | Abbott et al. | 430/139 |
| 4,500,631 | 2/1985 | Sakamoto et al. | 430/967 |
| 4,731,322 | 3/1988 | Suzuki et al. | 430/966 |

FOREIGN PATENT DOCUMENTS

| | | | |
|---|---|---|---|
| P 2943854A1 | 5/1981 | Fed. Rep. of Germany . | |
| 1414455 | 11/1975 | United Kingdom | 430/139 |

OTHER PUBLICATIONS

R. T. Droege et al, Medical Physics 6 484 (1979) Influence of Metal Screens on Contrast in Megavoltage X-Ray Imaging.

Jevbratt et al., Acta Radiologria 10, 443 (1971).

H. Meertens et al., Phys. Med. Biol., 30, 313 (1985).

H. Meertens, Med. Phys. 12, 111 (1985).

J. W. Carpenter, "Radiographic films/materials", *Research Disclosure,* Aug. 1979, 18431, pp. 433–441.

*Primary Examiner*—Paul R. Michl

*Assistant Examiner*—Lee C. Wright

[57] ABSTRACT

A recording system for megavolt irradiation therapy, in which the recording is carried out by the therapeutic irradiation during the entire period of irradiation, comprising a silver halide film that has a gradation of at least 4 when exposed with visible light and of metal foils having atomic numbers of 22 to 50. It has improved image quality compared with known systems.

9 Claims, No Drawings

RECORDING SYSTEM FOR IRRADIATION THERAPY

FIELD OF THE INVENTION

The invention relates to a recording system for verification (checking the field) and documentation in therapy with ultrahard X-rays having a photon energy of over 1 MeV, whereby the recording is made by the therapeutic irradiation throughout the period of irradiation.

BACKGROUND OF THE INVENTION

In irradiation therapy it is necessary to check and document that the alignment of the field of irradiation on the area of the body to be treated is accurate and as planned. In irradiation in a stationary field with cobalt-60- and with linear- and circular accelerator sources, photographic exposures are also produced using the therapeutic irradiation exiting from the body of the patient. It is desirable hereby to extend the exposure time to the entire period of irradiation, in order to ensure precise documentation and to be able to recognize errors, caused for instance, by changes in the position of the patient during the irradiation. The quality of such verification radiographs becomes less satisfactory as the therapeutic irradiation becomes harder, however, because the contrast in the primary irradiation image is very low due to the diminishing weakening of the irradiation by the bones, and in addition, the unstructured scattered radiation from the body of the patient is also superimposed on the image. Even larger anatomical details such as, e.g., bronchia, can then no longer be recognized in these radiographs and they are unsuitable for documentation.

Numerous attempts have been made to obtain recordings with satisfactory recognizable detail, in spite of the existing difficulties. Thus, Jevbratt et al., Acta Radiologica 10, 433 (1971) investigated the suitability of various types of film for verification radiographs at 6 MeV and found that the best contrast is achieved on high-silver-content material test film at high density. Such films can only be processed automatically in special slow machines, which are not customarily used in hospitals. Practical recognition of detail is impaired because the radiographs, in addition to the image-forming points of high density, also often contain irregularly shaped clear fields, which are caused by the shadows of the shielding blocks used in the therapy and which dazzle the eye. This difficulty can be overcome by recopying, it is true, and the contrast can also be further increased, but the noise is also increased. According to Jevbratt, et al., "lith films" are also suitable, but are rejected by him because of the special processing necessary. Jevbratt, et al. also found that the image contrast on the material test film can be further improved if the film is laid between lead foils during exposure.

According to Droege et al., Medical Physics 6, 487 (1979), the essential function of these foils is to reduce the scattered radiation/primary radiation ratio. This effect is not influenced by the type of metal foil at photon energies greater than 4 MeV. For satisfactory results, however, foils with a weight per unit area of at least 3 g/cm$^2$ are required. For a cassette of the usual 24×30 cm size, this means an additional weight of over 4 kg, a load that the radiological personnel cannot reasonably be expected to handle.

Meertens et al., Phys. Med. Biol. 30, 313 (1985) review the present state of the film-foil art for verification in megavolt irradiation therapy and come to the conclusion that further improvement is unlikely. They therefore suggest a new type of liquid-ionization detector for digital measurement of the radiograph. In another publication, Medical Physics 12, 111 (1985), digital processing of film radiographs to improve detail recognizability is also suggested by Meertens.

It is now the object of the present invention to give a recording system for verification and documentation in irradiation therapy at photon energies above 1 MeV, which is improved compared with the known systems with respect to detail recognizability and image contrast, which gives satisfactorily recognizable detail also at densities below 2.3, and whose recording material can be processed with the processing machines usually available in X-ray departments, and which after this processing has an immediate satisfactory image quality.

Further objects are evident from the following description.

SUMMARY OF THE INVENTION

In accordance with this invention there is provided a recording system for verification and documentation in X-ray irradiation therapy with photon energies greater than 1 MeV, whereby the recording is made by the therapeutic irradiation throughout the period of irradiation comprising (a) a photographic recording material having at least one silver halide emulsion layer, and (b) at least one metal foil in contact with at least one silver halide layer, characterized in that the photographic recording material contains silver halide grains having an average size of 0.05 to 0.4 μm, a maximum silver coating weight of 5 g Ag/m$^2$, and when exposed with radiation of a wavelength λ range of 430 to 550 nm, produces an average gradation of at least 4 in the density range of 0.5 to 2.0, and that the at least one metal foil contains one or more metals having an atomic number in the range of 22 to 50.

The system of the invention, as is shown by the examples described below, yields images of better detail recognizability in the density range of 0.5 to 2.3 than the systems according to the state of the art. This result is surprising to those skilled in the art. According to generally acknowledged experience, in fact, with X-ray exposure the contrast, independent of the specific properties of the emulsion, in particular independent of its behavior towards visible light, is always equal to 2.303 times the density (see, e.g., Mees: The Theory of the Photographic Process, Third Edition 1966, p. 187). This relation gives an upper limit for the contrast. In practice, the contrast may be lower, if the density approaches the maximum or the film was not fully developed. It follows from this that a higher film contrast necessary for satisfactory detail, is only formed at high density. The superior image quality obtained with the system of the invention even in the middle density range, was therefore not to be expected.

The methods and additives known to those skilled in the art can be used to produce silver halide emulsions for the photographic recording material of the invention, such as those listed, for example, in Research Disclosure No. 17643 (December, 1978), but this is not intended to express any limitation. It must be noted, however, that the gradation of the recording material measured by the method described in Example 1 is at least 4. This can be achieved, e.g., by producing an emulsion with a narrow grain size distribution by the pAg-regulated twin-jet method. A recording material gradation of above 5 is particularly preferred.

The speed of the emulsion can be influenced by suitable measures known to those skilled in the art during the precipitation and chemical ripening. The speed has regularly to be adjusted so that at the customary individual doses in irradiation therapy of about 0.5 to 2 Gy, film densities of the image-forming parts of 0.5 to 2 are preferably obtained. An average grain size (numerical average) of 0.05 to 0.4 μm has proven to be practicable for this; the range of 0.1 to 0.3 μm is preferred.

The silver coating weight of the emulsions does not need to be orientated to the customary high values for foil-less X-ray films. In general, a total coating weight (sum of all silver-containing layers) of 5 g $Ag/m^2$ is adequate. Silver weights of less than 4 $g/m^2$ are preferred. These boundary values ensure that the recording materials can be developed in customary processing times of less than 120 seconds, preferably about 90 seconds.

The layer supports of the recording material can be transparent, colorless or colored, for viewing the verification radiographs in transmitted light or they can be opaque-white for viewing in incident light. By suitable selection of the layer support, the verification radiographs can easily be distinguished from the diagnostic X-ray films, which are usually produced on blue-tinted supports. A clear, colorless polyethylene terephthalate layer support is preferred.

In addition to emulsion layers, the recording materials can contain silver-free auxiliary layers, which, e.g., are intended to produce mechanical protection of the emulsion or an anticurl effect.

The metal foils used according to the invention can consist of at least one metal whose atomic number is at least 22 (titanium) and at most 50 (tin). If they contain several metals, these can be used in the form of a homogeneous alloy or else as a layer material. The selection of the foil material can be governed by practical aspects, such as mechanical strength, soiling tendency, and price. Steel foils are preferred. The weight of the material for the front and back foils can be the same or different; according to the invention, the weight is between 0.1 and 2.5 $g/cm^2$. The range of 0.5 to 1.5 $g/cm^2$ is preferred.

EXAMPLES

The following examples are intended to further illustrate the invention, without limiting it to the forms of realization shown here.

EXAMPLE 1

(Production of the Recording Material)

A silver chlorobromide emulsion with a homogeneous halide distribution was produced by the pAg-regulated twin-jet method. The numerical average value of the grain size, expressed as the diameter of the spheres equal in volume to the grains, was measured with an instrument according to German Pat. No. 2,025,147, and was 0.22 μm. The emulsion was flocculated, washed, redispersed, chemically ripened with thiosulfate and gold salt, and after customary coating agents had been added, was applied onto a polyethylene terephthalate layer support provided with an anticurl backing layer. The silver coating weight was 3.8 $g/m^2$. A gelatin protective layer of 1 $g/m^2$ was applied at the same time as the emulsion layer. One part of the film thus obtained was exposed through a step wedge with an electroluminescence sensitometer (principal emission 430–550 nm) and was developed in an X-ray film roll processing machine in a total processing time of 90 seconds. The temperature of the developer was 34° C. and it had the following composition:

| Ingredient | Amount (g) |
|---|---|
| Hydroquinone | 24.0 |
| Phenyl pyrazolidinone | 0.75 |
| Sodium sulfite, anhydrous | 60.0 |
| Sodium metaborate | 33.0 |
| Sodium hydroxide | 19.0 |
| Potassium bromide | 10.0 |
| 6-Nitrobenzimidazole | 0.5 |
| Disodium salt of ethylene diamine tetraacetic acid | 3.5 |
| Glutaraldehyde sodium bisulfite, 30% solution | 50 mL |
| Water to make up to | 1000 mL |

Using a transmitted light densitometer, an average gradation of 5.4 over the density range of 0.5 to 2.0 was measured for the developed film.

EXAMPLE 2

(Production of the Recording Material)

Using the pAg-regulated twin-jet method, a silver bromoiodide emulsion with 1.8 mol-% of iodide was produced. The numerical average value of the grain size was 0.34 μm. The emulsion was flocculated, washed, redispersed, chemically ripened using thiosulfate and gold salt, and after the addition of customary coating agents, was applied onto a polyethylene terephthalate layer support provided with an antihalation backing.

The silver coating weight was 4.9 $g/m^2$. A gelatin protective layer of 0.9 $g/m^2$ was applied at the same time as the emulsion layer. Part of the film thus obtained was exposed, developed, and measured as described in Example 1. The gradation was 4.1.

EXAMPLE 3

A 24×30 cm sheet of the film produced as described in Example 1 was placed in a book cassette provided with 2 steel foils, each 1 mm thick. This system was exposed to X-ray irradiation, produced using an electron linear accelerator with an electron energy of 8 MeV. The distance between the target and the cassette was 1 m. A model of a thorax was immediately in front of the cassette in the path of the rays. The exposure was carried out at an energy dose of 1.5 Gy. After exposure, the film was developed as described in Example 1. An X-ray picture was obtained with a density range of 0.7 to 1.3, on which finer details, e.g., the edges of the vertebrae, were sharply delineated and clearly recognizable.

EXAMPLE 4

The test described in Example 3 was repeated with the modification that tin foils, 2 mm thick, were used instead of the steel foils. A radiograph with a density range of 1.0 to 1.6 was obtained with likewise clearly recognizable edges of the individual vertebrae.

EXAMPLE 5

A 24×30 cm sheet of the film produced as described in Example 2 was exposed and developed as described in Example 3. A radiograph with a density range of 1.7 to 2.3 and clearly recognizable detail was obtained.

CONTROL A

A commercial irradiation therapy documentation film, which was coated on both sides of a layer support with a silver bromoiodide emulsion (total coating weight 4.3 g $Ag/m^2$) having a numerical grain size average of 0.22 μm, but which when tested according to Example 1 gave a gradation of only 2.3, was exposed as in Example 3 between two copper foils, 1 mm thick, and was processed. A radiograph with a density range of 1.5 to 1.9 was obtained, on which the spinal column still appeared with sufficient resolution to show individual vertebrae, but their edges could no longer be recognized.

CONTROL B

A film as described in Example 1 was exposed between two lead foils, 0.5 mm thick, as described in Example 3 and was developed. A radiograph with a density range of 1.3 to 1.7 was obtained, in which likewise the edge of the individual vertebrae could no longer be recognized.

From these examples it follows that only the combination of metal foil and photographic recording material of the invention makes satisfactory quality of the radiographs possible.

I claim:

1. Recording system for verification and documentation in X-ray irradiation therapy with photon energies greater than 1 MeV, whereby the recording is made by the therapeutic irradiation throughout the period of irradiation comprising (a) a photographic recording material having at least one silver halide emulsion layer, and (b) at least one metal foil in contact with at least one silver halide layer, characterized in that the photographic recording material contains silver halide grains having an average size of 0.05 to 0.34 μm, a maximum silver coating weight of 5 g $Ag/m^2$, and a narrow grain size distribution so that when the material is exposed with radiation of a wavelength range of 430 to 550 nm an average gradation of at least 4 in the density range of 0.5 to 2.0 is produced, and that the at least one metal foil contains one or more metals having an atomic number in the range of 22 to 50.

2. Recording system according to claim 1 wherein at least 60 mol-% of the silver halide of the emulsion layer is silver chloride.

3. Recording system according to claim 1 wherein the average gradation of the recording material is at least 5.

4. Recording system according to claim 1 wherein the average size of the silver halide grains is 0.1 to 0.3 μm.

5. Recording system according to claim 1 wherein the metal foil is steel.

6. Recording system according to claim 1 wherein the metal foil is copper.

7. Recording system according to claim 1 wherein the metal foil is tin.

8. Recording system according to claim 1 wherein the metal foil has a weight per unit area of between 0.1 and 2.5 $g/cm^2$.

9. Process for verification and documentation in X-ray irradiation therapy with photon energies greater than 1 MeV, characterized in that a recording system according to claim 1 is used and the photographic recording material is processed in an X-ray film processing machine in a total processing time of less than 120 seconds.

* * * * *